United States Patent [19]

Pajula

[11] Patent Number: 4,792,381

[45] Date of Patent: Dec. 20, 1988

[54] CLOSED AND COMPACT PRESS SECTION OF A PAPER MACHINE WITH DOUBLE S SHAPED PATH OR MIRROR IMAGE THEREOF

[75] Inventor: Juhani Pajula, Jyväskylä , Finland

[73] Assignee: Valmet Oy, Finland

[21] Appl. No.: 96,397

[22] Filed: Sep. 11, 1987

[30] Foreign Application Priority Data

Sep. 12, 1986 [FI] Finland ..... 863713

[51] Int. Cl.[4] ..... D21F 3/04

[52] U.S. Cl. ..... 162/360.1; 162/305; 162/306

[58] Field of Search ..... 162/305, 306, 358, 360.1, 162/359, 205, 206

[56] References Cited

U.S. PATENT DOCUMENTS

| | | | |
|---|---|---|---|
| 3,861,996 | 1/1975 | Dorfel | 162/360.1 |
| 4,075,056 | 2/1978 | Ely et al. | 162/360.1 |
| 4,086,131 | 4/1978 | Rempel et al. | 162/360.1 |
| 4,188,262 | 2/1980 | Kankaanpaa | 162/360.1 |
| 4,209,361 | 6/1980 | Kankaanpaa | 162/360.1 |
| 4,252,241 | 6/1985 | Laapotti | 162/360.1 |
| 4,556,451 | 12/1985 | Ely | 162/360.1 |
| 4,704,192 | 11/1987 | Cronin | 162/360.1 |

*Primary Examiner*—David L. Lacey
*Assistant Examiner*—K. M. Hastings
*Attorney, Agent, or Firm*—Steinberg & Raskin

[57] ABSTRACT

A closed press section of a paper machine for removing water from the paper web passing therethrough. A compact press roll combination is provided with several press nips being formed in association with various rolls, and between which the web runs supported by roll surfaces without substantially long free draws. The press section comprises a first nip formed by two press suction rolls, through which two felts pass, the first felt functioning as a pick-up felt and moving the web from a pick-up point through the first press nip, and the second felt moving the web from the first nip to the second press nip of the press section. The second press nip is formed at a lower circumference of a smooth-surfaced, large diameter center roll, through which the second felt runs. Another smooth-surfaced, large diameter center roll is mounted in bearings and has a circumference located a short distance from the circumference of the first center roll, with a third press nip being formed at an upper circumference of the second center roll, and through which another press felt is guided. The web is detached from the smooth surface of the second center roll after the third press nip and is conveyed to the drying section of the paper machine. The paper web is essentially conveyed along a path shaped like an S or a mirror image thereof around the two center rolls, so that both sides of the web are pressed against a smooth surface of a respective center roll.

24 Claims, 3 Drawing Sheets

CLOSED AND COMPACT PRESS SECTION OF A PAPER MACHINE WITH DOUBLE S SHAPED PATH OR MIRROR IMAGE THEREOF

BACKGROUND OF THE INVENTION

The present invention relates to an essentially closed press section of a paper machine for removing water from a paper web, the press section comprising a compact press roll combination in such a manner that its different rolls form several press nips, between which the web is guided to run principally supported by a roll surface without substantially long free draws.

Such press sections are generally used in paper machines in which there are several press nips through which the web and the water-removing fabric, such as a single or twin press felt, run. Reference is made to Valmet Oy Finnish Patent Applications Nos. 781,426; 821,995, to Valmet Oy U.S. Pat. No. 4,209,361, to Beloit Canadian Pat. No. 1,068,525, and to U.S. Pat. No. 4,075,056, as examples of the state of the art.

The Valmet Oy "Sym-Press II" (trademark) press section is known from U.S. Pat. No. 4,209,361. A press of this type has virtually become a standard fixture among various paper machine manufacturers. With this well-known press, several practially important advantages are attained. One of the most important advantages is that the paper web can be passed through the entire press section supported on a solid surface and as a closed draw, first between the first nip and the second nip on a pick-up felt over the sector of the press suction roll, and then through the third nip supported on the smooth surface of the center roll of the press which is usually a stone roll.

The object of the present invention is to further develop the Valmet Oy "Sym-Press II" press section.

The present invention is based on a great deal of experience that has been generated when using the "Sym-Press II" press section.

A feature of the basic version of the "Sym-Press II" is that only one side of the web is pressed against a smooth stone surface or a similar synthetic surface. This results in the web becomes asymmetric to a certain extent, and is undesirable regarding certain paper qualities.

A separate additional nip which is formed between the top stone roll and the bottom press roll has been used in association with "Sym-Press II". This additional nip is aimed at improving water removal and increasing the symmetry of the web by pressing both sides of the web against a smooth stone roll. The distance between the stone rolls will be quite long.

A problem in such a press section is the manner of directing the web from the first stone roll to the last additional nip, because the web tends to come loose from the lower felt carrying the same. The press section will also be quite bulky, which adds to the paper machine room expenses and makes the use of the press difficult. Another drawback is the very high frame section and its tendency to vibrate, partially due to the fact that it is necessary to support the bearings of the massive stone roll above the last nip and on the frame beams above the stone roll.

The above-described "Sym-Press II" that is equipped with an additional nip, is not often suitable for renovations of paper machines, due to bulkiness.

SUMMARY OF THE INVENTION

Accordingly, it is an object of the present invention, to provide a press section for a paper machine in which the above-noted drawbacks can be avoided.

It is also an object of the present invention to provide a press section, in which both sides of the web are pressed against a smooth stone roll or similar synthetic surface, so that the surfaces and the inner structure of the web will be symmetric.

It is another object of the present invention to provide a press section in which, when utilizing two smooth stone rolls, a paper guide roll is not required between the same.

It is an additional object of the present invention to provide a press section in which only two relatively expensive press suction rolls are required, as opposed to a "Sym-Press II" fitted with an additional nip where three such rolls are required.

It is still another object of the present invention to provide a press section in which the frame structure is lower and simpler than before.

It is still a further object of the present invention to provide a press section in which the paper can be reliably guided through the press section and the broke removed therefrom and from the press section in a controlled manner.

It is yet another object of the present invention to provide a press section in which the characteristic features of "Sym-Press" presses are preserved. In other words, the paper web is, through the entire press section, supported on a solid surface without any detrimentally long free draws.

It is even another object of the present invention to provide a press section which, from the point of view of the press frame, can be so designed that tendency to vibrate is smaller than previously. In certain applications of the present invention, this particular object can be attained by making the frame of the press section lower and stiffer than before, and also by raising the lower specific vibration frequencies of the frame.

These and other objects are attained by the present invention which is directed to an essentially closed press section of a paper machine for removing water from a paper web passing therethrough, the press section comprising a compact press roll combination arranged to form several press nips between which the web is guided to run, principally supported by roll surfaces without substantially long free draws. The press section comprises, in combination and in the following order in a running direction of the web through the press section, two press suction rolls forming a first press nip and two felts passing through said first press nip. A first of said two felts is a pick-up felt for moving the web from a pick-up point to said first press nip. A second of the two felts moves the web after the same passes through the first nip.

A first, smooth-surface, large diameter center roll forms a second press nip at a lower circumference thereof. The second felt runs through the second press nip. A second smooth-surface large diameter center roll is situated with a circumference thereof located a short distance from the circumference of the first center roll. This second smooth surfaced large diameter center roll may be mounted substantially at the same horizontal plane as the first center roll, or may be mounted slightly above a horizontal plane passing through a center or rotation of the first center roll.

The paper web is essentially directed along a path shaped substantially as an S or a mirror image thereof around each center roll, so that both sides of the web are pressed against the smooth surface of a respective center roll. The second center roll also forms a third press nip at a top circumference thereof, with a third press felt being guided through the third press nip. The web is detached from the smooth surface of the second center roll after the third press nip and is directed to a drying section of the paper machine.

Therefore, for attaining the objects noted above and those which will become apparent below, a principal characteristic feature of the present invention is that the press section comprises, in combination, the following components which, in the running direction of the web, are arranged in the following order:

- a first press nip formed by two press suction rolls, through which two felts are passed. The first felt functions as a pick-up felt and moves the web from the pick-up point to the first press nip, while the second felt moves the web to the second press nip of the press section;
- a first smooth-surfaced and large-diameter center roll, with the second press nip of the press section being formed at a lower circumference thereof. The second press felt also runs through the second press nip;
- a second, smooth-surfaced and large-diameter center roll having a circumference located a short distance from the circumference of the first center roll. The second smooth-surfaced center roll may be mounted in bearings essentially in the same horizontal plane as the first center roll, or, alternatively, may be mounted slightly above the first center roll (i.e. in a plane above a horizontal plane passing through a center of rotation of the first center roll);
- the paper web is led essentially along a path shaped as an S or a mirror image thereof around the two center rolls, so that both sides of the web are pressed against the smooth surface of a center roll; and
- a third press nip is formed at a top circumference of the second center roll, through which another press felt is guided. After this third press nip, the web is detached from the smooth surface of the center roll and conveyed to a drying section of the paper machine.

In a press section in accordance with the present invention, both sides of the web are pressed against a smooth surface of a stone roll. The result of this treatment is a web having both sides which are smooth and an inner structure which is symmetrical.

A press section in accordance with the present invention is also very compact, i.e. quite short. The web can be conveyed therethrough virtually as a closed draw.

Since the two stone rolls may be located substantially in the same horizontal plane in a press section in accordance with the present invention, the stone rolls can be fixedly mounted in bearings on a relatively low frame section which is directly supported on the foundation of the paper machine room. The end of the web can also be conveyed without difficulty through a press section in accordance with the present invention. Additionally, removal of broke from the press section in accordance with the invention can be arranged without significant difficulty.

BRIEF DESCRIPTION OF THE DRAWINGS

The present invention will now be described in greater detail with reference to exemplary embodiments illustrated in the drawings, and to which the present invention is not intended to be restricted. In the drawings.

DESCRIPTION OF THE PREFERRED EMBODIMENTS

Figure 1:
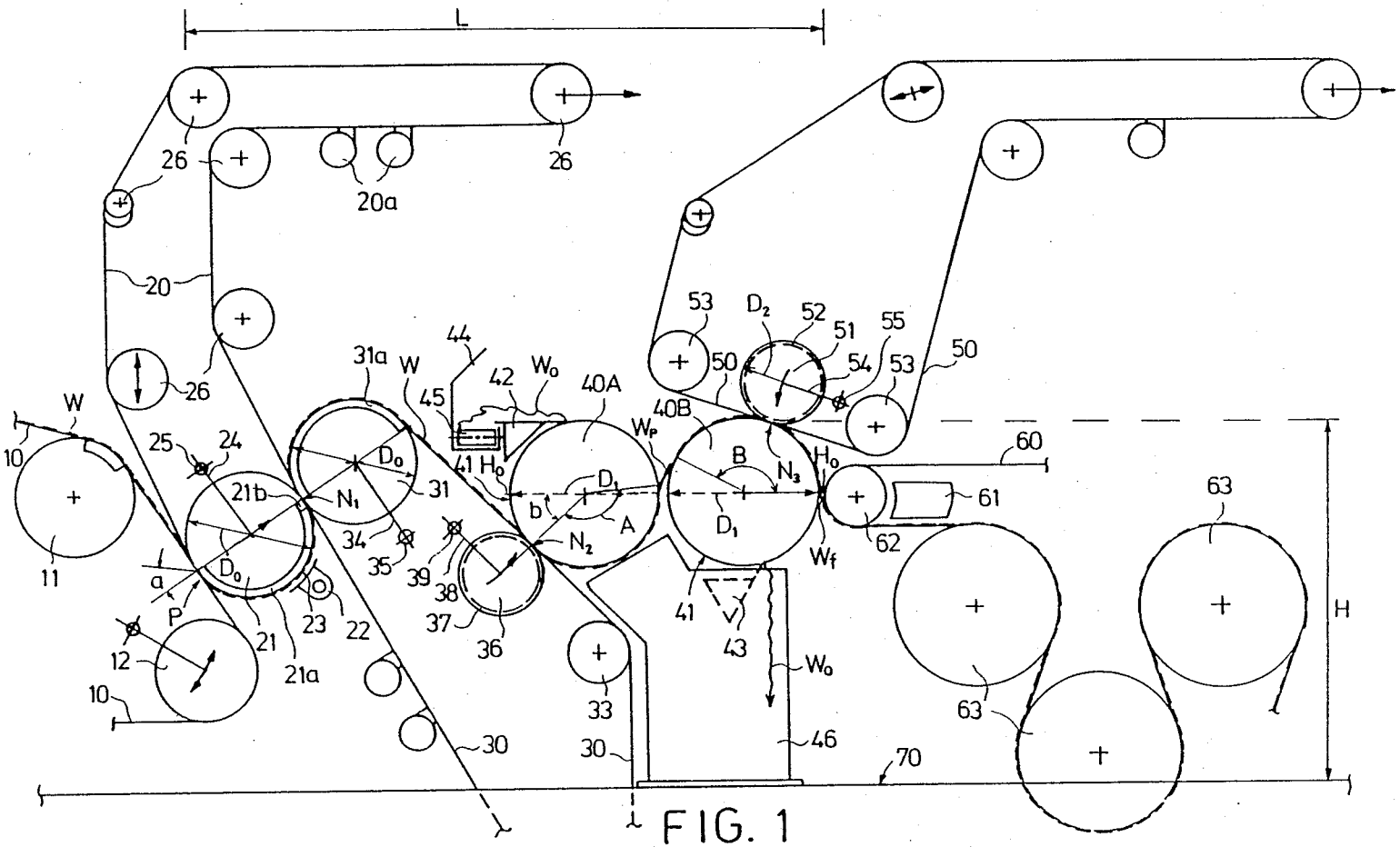
FIG. 1 is a schematic side view of an advantageous embodiment of the present invention.

The common design features of the press sections illustrated in FIGS. 1, 2, and 3 will first be described. The web W arrives at the press section on a wire 10 from the forming section of the paper machine, is separated from the wire 10 on the downwardly-slanting draw between rolls 11 and 12 at the pick-up point P, and then moved onto a first felt 20 to which the web is caused to adhere by means of influence of a vacuum of a suction zone 21*a* of a press suction roll 21. The first felt 20 is guided by spreader and guide rolls 26 and is trimmed by equipment 20*a*.

A first nip $N_1$ of a press section in accordance with the present invention is formed between two press suction rolls 21 and 31. The first one 21 of these press suction rolls 21, 31 simultaneously functions as a pick-up roll. At the suction zone 21*a* thereof, i.e. at the pick-up point P, the web W is detached from the forming wire 10 and moved over the suction zone 21*a* to the first nip $N_1$ on top of the first felt 20 which functions both as a pick-up felt and as a press felt in the first nip $N_1$. At the first nip $N_1$, there is a suction zone 21*b* on the suction roll 21 at which the vacuum is higher in than in the previously larger suction zone 21*a* which is principally a detaching and retaining zone for the web W. In other words, the first suction roll 21 is equipped with a suction sector roll with suction sectors 21*a*, 21*b* extending at least from the pick-up point P past the first nip $N_1$ over a contact sector of the first felt 20.

The first suction roll 21 is mounted in bearings onto arms 24 which are, by means of joints 25, connected to frame parts (not illustrated) for loading the first nip $N_1$. There is a steam box 22 beneath the suction zone 21*a* which creates a steam treatment stretch 23 onto the suction zone 21*a*. In the stream treatment zone 23, the temperature of the web W and water retained by the web W is raised in a manner known as such for intensifying water removal in the first nip $N_1$.

A second press felt 30 is guided over and around the second press suction roll 31. A suction zone 31*b* is situated in the suction roll 31 at the nip $N_1$, at which the vacuum is higher than in the subsequent larger zone 31*a*. A vacuum is only maintained in zone 31*a* which is sufficient for securing the web W to the outer surface 30 of the felt 30. In other words, the second press suction roll 31 is equipped with an upper suction zone or zones 31*a*, 31*b* which extend at least from the first nip $N_1$ to the point where the second press felt 30 and the web W supported by the same separate from the surface of the suction roll 31.

Figure 2:
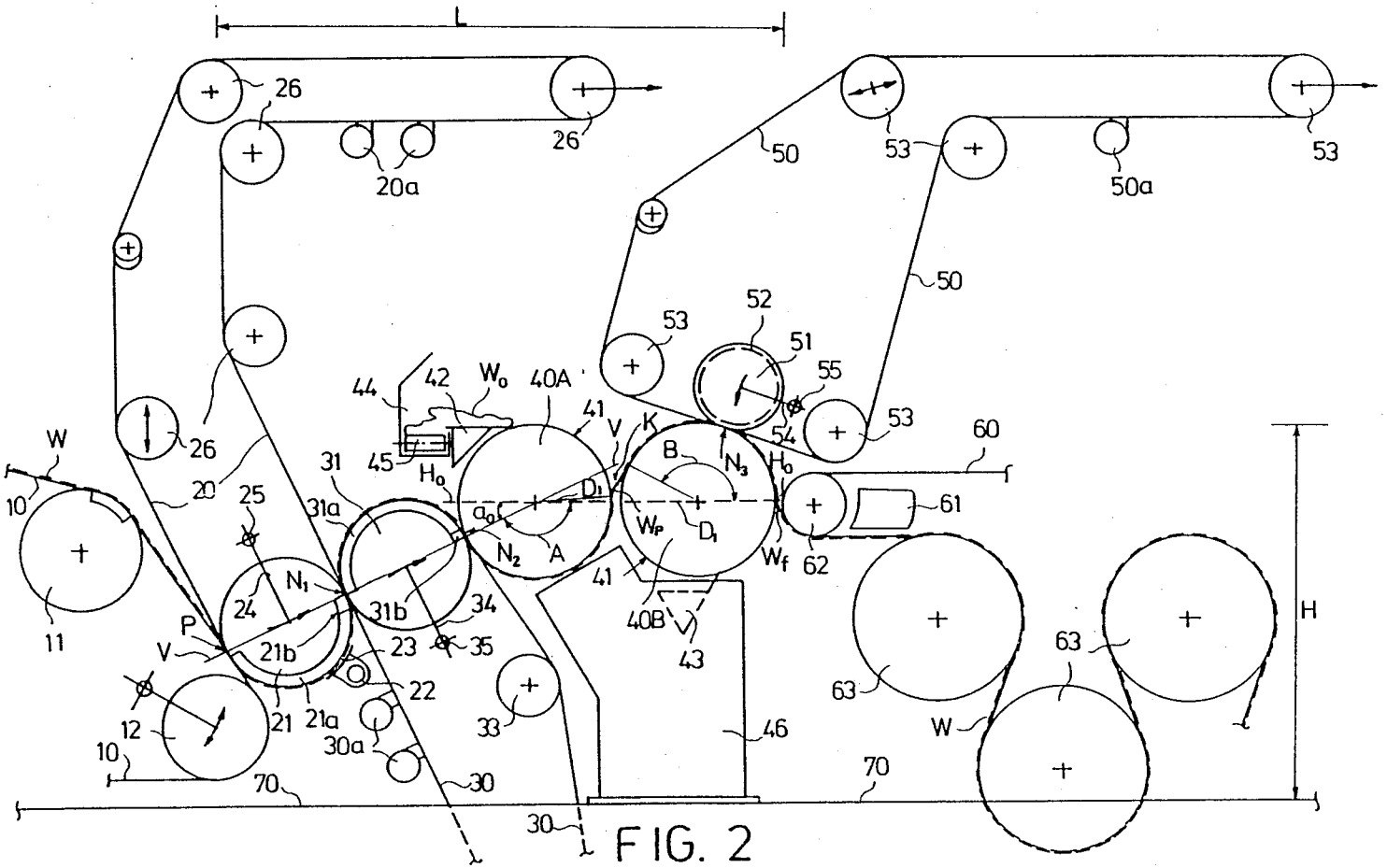
FIG. 2 is a view similar to FIG. 1 of an especially compact embodiment of the present invention which is especially suitable for renovations when available space is restricted.

The second suction roll 31 is mounted through bearings to lower arms 34, whose lower ends are by means of joints 35 connected to the frame section in order to load the first nip $N_1$, or a second nip $N_2$ (FIG. 2). The second press felt 30 is guided by rolls 33 and trimmed by equipment 30a.

The press section comprises two large-diameter and smooth-surfaced center rolls 40A and 40B, in conjunction with which two or three press nips $N_2$, $N_3$ and $N_4$ (FIG. 3) are formed, essentially for removing water from the web W. The center rolls 40A and 40B are preferably stone rolls or rolls with surfaces having web transfer properties similar to stone rolls, for instance Microrock (TM) coated surfaces. The center axes of the center rolls 40A and 40B are essentially located in the same horizontal plane $H_0$—$H_0$ (FIGS. 1 and 2).

In the most advantageous embodiment of the present invention, the center rolls 40A and 40B have the same diameters $D_1$, and have been mounted through bearings from underneath to base 46 which is directly supported onto structures of a floor plane 70 of the paper machine (i.e. the floor of the paper machine room).

Figure 3:
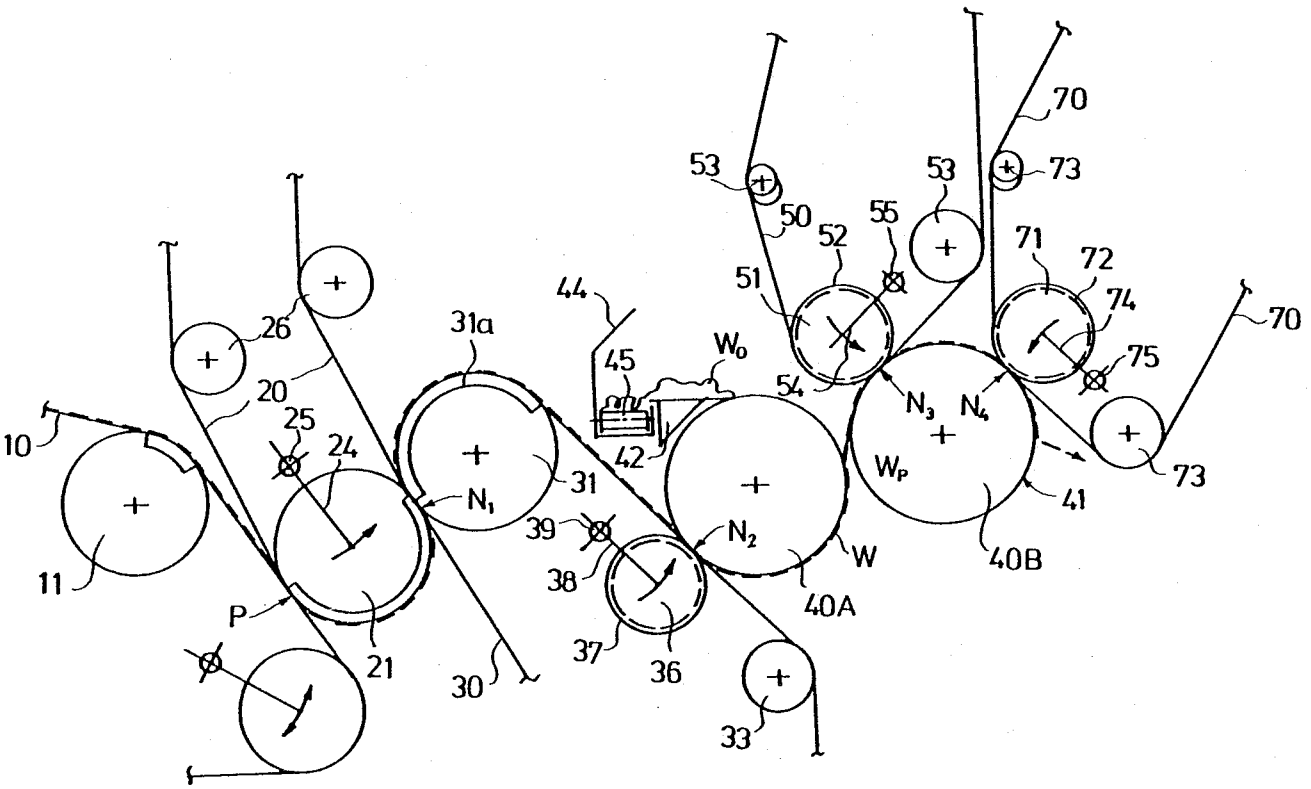
FIG. 3 is a view similar to FIG. 1 of a variation of a press section in accordance with the present invention in FIG. 1, in which four press nips are provided.

As shown in FIGS. 1 and 3, the second water-removing nip $N_2$ of the press is formed between a recess-surfaced (or recessed-surface) 37 press roll 36 and a first center roll 40A. The recessed surface 37 press roll 36 is mounted by arms 38 and joints 39 onto to the lower frame section. As the center roll 40A is, with respect to the web W, more adhesive than the press felt 30, the web follows the center roll 40A after the second nip $N_2$, being tightly pressed against its smooth surface 41. Then, the web W is moved by a free draw $W_p$ which is as short as possible, to a second large diameter center roll 40B which is preferably similar to the first center roll 40A.

A doctor blade 42 is located above the first center roll 40A, in association with a groove-shaped frame section 44. A broke conveyor 45 is arranged in the section 44 and guides broke $W_0$ doctored from the surface of the roll 40A away from the press section further on to a pulper. The broke conveyor 45 may be, for example, a belt conveyor, a screw conveyor, or a pneumatic conveyor. There is a doctor blade 43 underneath the second center roll 40B, which keeps the second center roll 40B clean and removes from its surface 41 broke $W_0$ which falls directly to a pulper located beneath or to a broke conveyor.

There is a third press nip $N_3$ in conjunction with the second center roll 40B, which is formed between a recessed surface 52 press roll 51 and the second center roll 40B. The recessed-surface 52 press roll 51 is supported through arms 54 and joints 55.

A press fabric 50 guided by lead-in and spreader rolls 53, is guided through the third nip $N_3$. The press fabric 50 is trimmed with equipment 50a known as such.

After the third nip $N_3$, and possibly a fourth nip $N_4$ (FIG. 3), the web W is led by a very short free draw $W_f$ to a drying wire 60 of a drying section. The drying wire 60 is conveyed, and guided by a lead-in roll 61, as close as possible to the second center roll 40B. After having been made to adhere to the surface of the drying wire 60 by suction equipment 61, the web W is then taken to the first drying group comprising drying cylinders 63, in which a single-wire draw is used, for example.

Special features of the variations illustrated in FIGS. 1, 2 and 3 will now be described below.

As shown in FIG. 1, the first nip $N_1$ is separate from all other nips. After the second suction roll 31, the web is conveyed as a downwardly-sloping draw along the felt 30 to the second nip $N_2$. The second suction roll 31 is located slightly higher then the horizontal plane in which the first and second center rolls 40A, 40B are mounted in bearings. Alternatively, the second suction roll 31 may preferably be located in the same horizontal plane in which the first and second center rolls 40A, 40B are mounted in bearings. The nip $N_1$ is preferably situated between the horizontal plane $H_0$—$H_0$ passing through the center axes of the center rolls 40A and 40B, and a horizontal plane passing through the second nip $N_2$. The plane passing through the rolls 21 and 31 and the nip $N_1$ is, in the running direction of the web, upwardly sloping at an angle a which is preferably a=-about 20° to 50°. The second nip $N_2$ is located in a sector b underneath the plane $H_0$—$H_0$. The angle of section b is preferably about 30° to 60°.

As illustrated in FIG. 2, a very compact, especially extremely short (length L), press section is provided. In a press section in accordance with FIG. 2, the length L of the press from the pick-up point P to the point where the web is detached from the last center roll 40B, is usually L=about 5,000 to 6,000 mm. In an embodiment in accordance with FIG. 1, the corresponding distance L is usually L=6,000 to 7,000 mm. This compactness is accomplished by the suction roll 31 directly forming the second nip $N_2$ with the first center roll 40A, with zone **31*b* of higher suction being at the second nip $N_2$. The first and the second nips $N_1$ and $N_2$ are preferably in the same plane V—V, which is at an angle of $a_0$with respect to the horizontal plane. The angle $a_0$ is generally $a_0$=-about 20° to 40°. As shown in FIG. 2, the second suction roll 31 is mounted in bearings from beneath by means of arms 34 and joints 35** to the lower, relatively low frame section (not illustrated).

FIG. 3 illustrates a variation in accordance with FIG. 1, which is fitted with a fourth nip $N_4$ arranged in conjunction with the last center roll 40B. Accordingly, the third nip $N_3$ is moved backwardly, compared with the nip $N_3$ illustrated in FIGS. 1 and 2. The fourth nip $N_4$ is formed by a recess-surfaced 72 press roll 71, which is supported and loaded by arms 74 in turn loaded about horizontal joints 75. A fourth press fabric 70, guided by lead-in and spreader rolls 73, passes through the fourth nip $N_4$. The second center roll 40B is also positioned higher than the first center roll 40A, as illustrated.

An embodiment of the present invention in accordance with FIG. 3 is especially well-suited for relatively thick paper qualities, and for qualities from which it is difficult to remove water, or with which there are particular reasons for attaining high dry content after the press.

As can be seen from the figures, an essential feature of the present invention is that the web W is transferred along a path shaped substantially as a double S (or a mirror image of a double S), first over the suction rolls 21 and 31, and then supported by the smooth surfaces 41 of the center rolls 40A and 40B. The surface of the web W situated against the press fabric whose surface is rougher than the surface 41 on the first center roll 40A, moves onto the second center roll 40B to be pressed against the smooth surface 41 of this second center roll 40B. Thus, both surfaces of the web W are treated symmetrically, and the structure of the web W together with its filler and fine matter distributions, becomes essentially symmetrical, also taking into account the water removing directions.

A sector A, in which web W turns on the first center roll 40A, is usually A=about 40° to 80°, preferably A=about 60° to 70°. A sector B in which the web W turns around the second center roll 40B is usually B=about 40° to 80°, preferably B=about 55° to 65°.

At least one of the center rolls 40A, 40B is equipped with its own mechanical drive, so that power can be transmitted to the center rolls 40A, 40B by means of mechanical transmission. Thus, the relationship of the circumferential speeds of the rolls 40A and 40B can be ensured and can be adjusted extremely precisely so that in the distance $W_p$, the draw and the stretch of the web W will be at the optimum level. This, for example, prevents the web W from being creased, while the draw and the detaching angle can be maintained extremely precisely at all times.

The frame section of the press section of the present invention is advantageous from the point of view of minimizing vibration, as all press nips are formed in conjunction with rolls that can be located extremely low in the frame section. Thus, the portion of the frame supporting heavy masses and loadings can be located extremely low, with the frame thus being rigid so that tendency to vibrate is smaller. Thus, even the lowest specific vibration frequencies of the frame will be reasonably quite high. The height H of a press section in accordance with the invention, i.e. the distance from the highest nip $N_3$ from the floor level 70 of the paper machine room, is generally H=about 3,500 to 4,000 mm. In the embodiments illustrated in FIGS. 1 and 3, the height H is essentially smaller than the width L of the press section. In an embodiment in accordance with FIG. 2, the height H is somewhat smaller or essentially as large as the length L of the press section. L is usually about 5,000–7,000 mm. In the embodiments illustrated in FIGS. 1 and 3, the length L is usually L=about 6,000 to 7,000 mm, with the height H usually being about 3,000 to 4,000 mm. In an embodiment in accordance with FIG. 2, the length L of the press section is usually L=about 5,000 to 6,000 mm, and the height H is usually H=about 3,000 to 4,000 mm.

The diameters $D_1$ of the center rolls 40A and 40B are usually in the range of about 1,400 to 2,000 mm, preferably in the range of about 1,500 to 1750 mm, for instance about 1,600 mm. In the present invention, the diameters $D_1$ of the center rolls 40A and 40B are essentially longer than the diameters $D_2$ of the recess-surfaced press rolls 36 and 51, which form nips together with the center rolls 40A and 40B. The relationship of the diameters $D_1$ of the center rolls 40A and 40B to the diameters $D_2$ of the press rolls 36 and 51, is preferably in the range of $D_1/D_2$=about 1.2 to 3, more preferably $D_1/D_2$=about 1.6 to 1.9. The diameter $D_0$ of the press suction rolls 21 and 31 is larger than the diameter $D_2$ of the press rolls 36, 51, and 71 (FIG. 3), but smaller than the diameter $D_1$ of the center rolls 40A and 40B.

The center rolls 40A and 40B are positioned as close to one another as possible from the point of view of constructional and operational considerations. In the figures, the distance between the rolls 40A and 40B is denoted by reference character K. This distance K is generally K=about 20 to 200 mm, preferably K=about 50 to 100 mm.

The paper web W is directly led from the surface of the first center roll 40A to the surface of the second center roll 40B without a paper lead-in roll. Three press felts are used in the press section of the present invention, the first one 20 of these press felts functioning both as the pick-up felt and as a felt passing through the first press nip $N_1$ while the second felt 30 functions as a felt passing through the first press nip $N_1$ and as the only felt passing through the second press nip $N_2$ formed in association with the first center roll 40A. The third press felt 50 functions as a press felt in the third press nip $N_3$ formed in conjunction with the second center roll 40B.

The preceding description of the present invention is merely exemplary, and is not intended to limit the scope thereof in any way. Various details of the present invention may differ from the exemplary embodiments and details described above, and may be greatly varied within the inventive concepts set forth herein.

I claim:

1. An essentially closed press section of a paper machine for removing water from a paper web passing therethrough, said press section comprising a compact press roll combination arranged to form several press nips between which the web is guided to run principally supported by roll surfaces without substantially long free draws, wherein said press section comprises, in combination and in the following order in a running direction of the web through said press section, first and second press section rolls forming a first press nip and two felts passing through said first press nip, a first of said two felts being a pick-up felt for moving the web from a pick-up point to said first press nip and a second of said two felts moving the web after the same passes through said first nip, a first smooth-surfaced, center roll and means forming a second press nip with said first center roll at a point on its lower circumference, said second felt running through said second press nip, a second smooth-surfaced, center roll having a circumference located a discrete distance from the circumference of said first center roll such that said first and second center rolls do not form a nip with one another, the paper web being led essentially along a path shaped substantially as an S or a mirror image thereof around said two press suction rolls and also around said two center rolls, so that both sides of the web are pressed against the smooth surface of a respective roll, and means forming a third press nip with said second center roll at a point on its upper circumference thereof, and a third press felt being guided through said third press nip, with the web being detached from the smooth surface of said second center roll after said third press nip and directed to a drying section of the paper machine, and said first and second press suction rolls and center rolls being arranged to lead the web thereabout essentially along said path shaped substantially as a double S or a mirror image thereof through said press section.

2. The combination of claim 1, wherein said means forming said second nip is a recessed surface press roll forming said second press nip with said first center roll, with the paper web being lead along a downwardly-sloping draw of said second felt from said second press suction to said second press nip.

3. The combination of claim 1, wherein horizontal planes passing through respective centers of rotation of said second center roll and said first center roll are substantially in alignment.

4. The combination of claim 1, wherein a center of rotation of said second center roll is mounted in a substantially horizontal plane above a substantially horizontal plane passing through a center of rotation of said first center roll.

5. The combination of claim 2, wherein a center of rotation of said second press suction roll is located slightly higher than a substantially horizontal plane substantially passing through centers of rotation of both said first and second center rolls.

6. The combination of claim 3, wherein a center of rotation of said second press suction roll is located substantially in the same substantially horizontal planes in which said first and second center rolls are mounted in bearings.

7. The combination of claim 1, wherein said first suction press roll is also a pick-up roll with said pick-up point situated on a circumference thereof.

8. The combination of claim 1, wherein said means forming said second press nip is said second press suction roll.

9. The combination of claim 1, additionally comprising a doctor blade arranged adjacent an upper circumference of said first center roll which is free from the running web, and a broke conveyor associated with said doctor blade, with which broke scraped off said first center roll by said doctor blade is conveyed away from said press section to a pulper.

10. The combination of claim 9, wherein said doctor blade is situated just below the uppermost point of the upper circumference of said first center roll.

11. The combination of claim 1, wherein both said first and second center rolls are supported from underneath by bearings upon a frame section directly supported upon the floor.

12. The combination of claim 1, additionally comprising means forming a fourth press nip after said third press nip with said second center roll at a point on its upper circumference thereof, and additionally comprising a fourth press felt running through said fourth press nip.

13. The combination of claim 1, additionally comprising a steam box arranged adjacent a bottom suction sector of said first press suction roll, for raising temperature of the running web and of the water retained therein to intensify water removal of the subsequent nips.

14. The combination of claim 1, wherein the length of said press section from the point where the web is picked up by said first suction press roll to a point where the web is detached from said second center roll, is about 5,000 to 7,000 mm.

15. The combination of claim 1, wherein the height of the press section from a floor level to an uppermost nip is about 3,000 to 4,000 mm.

16. The combination of claim 1, wherein the diameter of each of said center rolls is in the range of about 1,400 to 2,000 mm.

17. The combination of claim 1, wherein the discrete distance between the circumferences of said center rolls is about 20 to 200 mm.

18. The combination of claim 1, wherein the paper web is led directly from the surface of said first center roll to the surface of said second center roll, without a paper lead-in roll.

19. The combination of claim 1, wherein said second press felt is the only felt passing through said second nip.

20. The combination of claim 1, wherein said means forming said third press nip is a recessed surface roll forming said third nip with said second center roll.

21. The combination of claim 12, wherein said means forming said fourth press nip is a recessed surface roll forming said fourth press nip with said second center roll.

22. The combination of claim 1, wherein said first and second center rolls are stone rolls or rolls with surfaces having web transfer properties similar to stone rolls.

23. The combination of claim 1, wherein said first and second center rolls are positioned with respect to one another to transfer the web as a free draw from said first roll to said second roll over said discrete distance.

24. The combination of claim 7, wherein said first press suction roll is provided with at least one suction sector extending from the pick-up point for the web thereon past said first nip over a contact sector of said first felt, and said second press suction roll is provided with at least one upper suction zone extending at least from said first nip to a point where said second press felt and the web supported by the same leave the surface of said second suction roll.

* * * * *